United States Patent [19]

Vanover et al.

[11] 4,170,872

[45] Oct. 16, 1979

[54] BRACELET LINKAGE

[75] Inventors: Wallace F. Vanover; Kurt A. Rieth, both of Warwick, R.I.

[73] Assignee: Textron, Inc., Providence, R.I.

[21] Appl. No.: 933,715

[22] Filed: Aug. 15, 1978

[51] Int. Cl.[2] ..... A44C 5/10

[52] U.S. Cl. ..... 59/82

[58] Field of Search ..... 59/80, 82, 78, 91, 35; 63/4, 26

[56] References Cited

U.S. PATENT DOCUMENTS

| | | | |
|---|---|---|---|
| 1,556,465 | 10/1925 | Wendel | 63/26 |
| 1,589,423 | 6/1926 | Payton | 59/80 |
| 1,701,610 | 2/1929 | Forstner | 59/80 |
| 1,844,606 | 2/1932 | Selikoff | 63/26 |
| 1,847,901 | 3/1932 | Roy | 59/80 |
| 1,854,958 | 4/1932 | Santosuosso | 63/28 |
| 2,073,280 | 3/1937 | Lederer | 40/156 |
| 2,136,818 | 11/1938 | Kestenman | 59/80 |
| 2,143,703 | 1/1939 | Kestenman | 59/80 |
| 2,510,774 | 6/1950 | Engel | 63/26 |
| 2,536,391 | 1/1951 | Prestinari | 59/80 |

*Primary Examiner*—Francis S. Husar
*Assistant Examiner*—Gene P. Crosby
*Attorney, Agent, or Firm*—Thompson, Birch, Gauthier & Samuels

[57] ABSTRACT

A bracelet linkage comprising a plurality of link assemblies each of which includes an outer frame member having a central opening and a pair of downwardly extending tab means, an insert the outer wall of which is receivable within at least the major portion of the central opening and an inner member having slots adjacent to the ends of the bottom wall with the tab means of the frame member bent into the slots and a series of connector links connecting a plurality of link assemblies together in end-to-end relationship, these connector links also extending through the slots and about the ends of the tab means.

17 Claims, 30 Drawing Figures

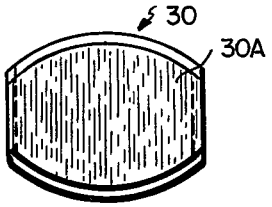
FIG. 11
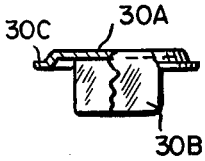
FIG. 13
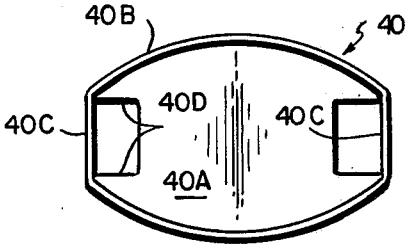
FIG. 14
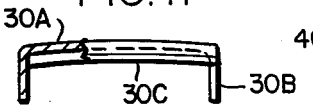
FIG. 12
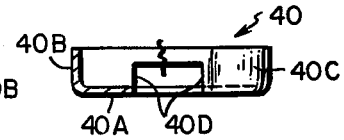
FIG. 16
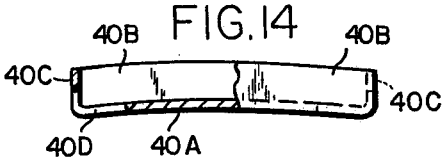
FIG. 15
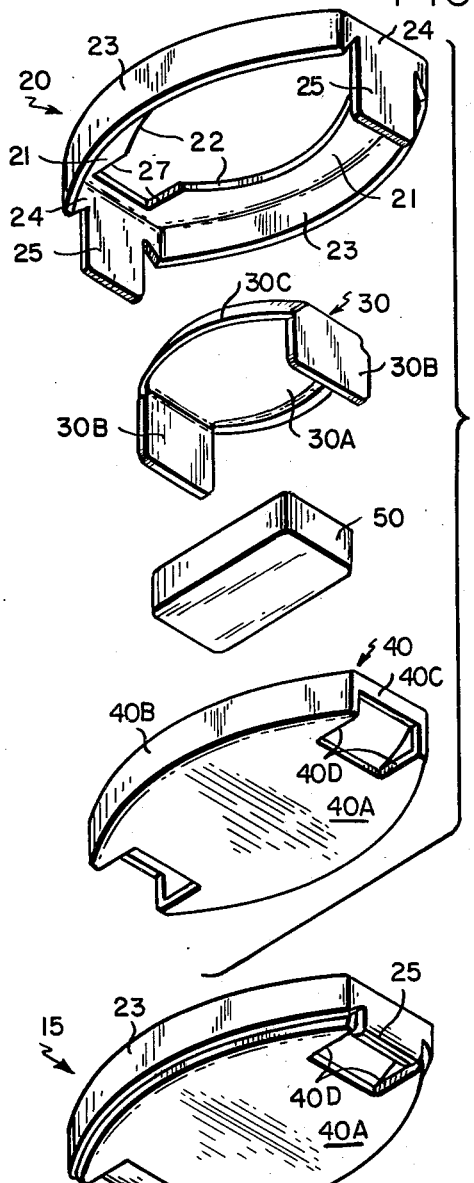
FIG. 17
FIG. 18
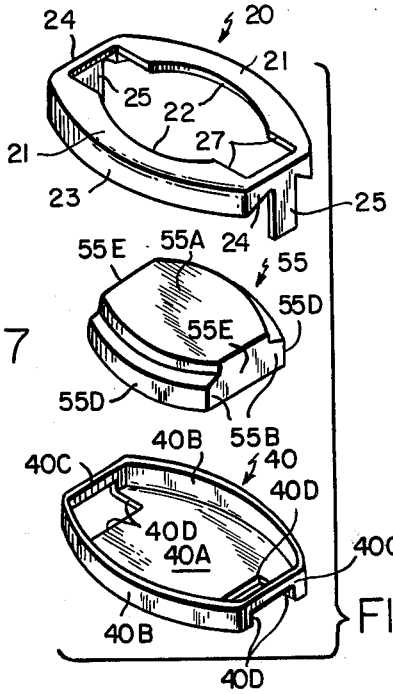
FIG. 19
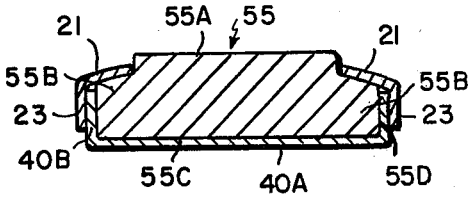
FIG. 20
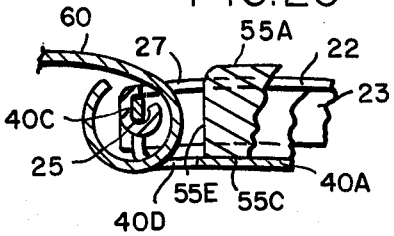
FIG. 21

BRACELET LINKAGE

BACKGROUND OF THE INVENTION

There as been a long-felt need for a bracelet linkage which can be provided with a wide selection of design variations yet which is durable and economical to manufacture and assemble.

While Kestenman U.S. Pat. No. 2,136,818 dated Nov. 15, 1938 discloses a bracelet linkage comprising a plurality of hollow box type link assemblies each of which includes an outer member 3, an inner member 12 having a gem or other ornament 11 mounted beneath an opening in the outer member, the gem is supported on the upper edges of the walls of the inner member and each link assembly must be attached to a pair of connecting links 2 by the looped flanges 6 and these flanges are likely to be deformed when the bracelet is worn.

While Lederer U.S. Pat. No. 2,073,280 dated Mar. 9, 1937 discloses a container 11 for holding a photograph, powder pad or rouge pad, one end of the outer member or cover 11 is connected to the bottom or base 15 by a hinge 22 and the other end is detachably connected to the base by the latch finger 27 which passes thru the slot 28 in the base. Furthermore the ears 20 of the base are exposed to view from the top of the assembly so that the base as well as the outer member must be made of precious metal or precious metal containing material. Lederer's container would be very expensive to manufacture and if a series of containers were connected together end to end to form a bracelet linkage, the bracelet would be extremely expensive.

Other prior patents which disclose products which have not met the long-felt need are:

Wendel U.S. Pat. No. 1,556,465 dated Oct. 6, 1925;

Forstner U.S. Pat. No. 1,701,610 dated Feb. 12, 1929;

Selikoff U.S. Pat. No. 1,844,606 dated Feb. 9, 1932;

Santosuosso U.S. Pat. No. 1,854,958 dated Apr. 19, 1932; and

Engel U.S. Pat. No. 2,510,774 dated June 6, 1950.

The above identified prior art is the closest prior art of which we are aware to a bracelet linkage embodying our invention as described and claimed in this application.

BRIEF SUMMARY OF THE INVENTION

One object of the invention is to provide a bracelet linkage which can easily be provided with a wide selection of design variations.

Another object is to provide such a linkage which is economical to manufacture.

A further object is to provide such a linkage which is durable in use.

A still further object is to provide such a linkage which is attractive in appearance.

Another object is to provide such a linkage which is heavy.

A further object is to provide such a linkage the visible parts of which can be made economically of gold-filled, gold plated or other precious metal containing materials.

Further objects and advantages of this invention will be apparent to persons skilled in the art from the following description taken in conjunction with the accompanying drawings.

In general a linkage embodying this invention includes a plurality of link assemblies each of which comprises an outer member which includes a pair of spaced side members, a pair of spaced end members extending between the side members to define a frame having a central opening, and a pair of bendable tab means, one extending downwardly from each of the end members. It also includes an insert comprising an upper member which is receivable within at least the major portion of the central opening of the outer member. It also includes an inner member which comprises a bottom wall, side flanges extending upwardly from the bottom wall, a pair of end members extending between the side flanges and a pair of slot means extending through the lower portion of the end members and the adjacent end portions of the bottom wall.

The bendable tab means of the outer member are bent about the end members of the inner member with their ends extending through the slot means of the inner member so that the outer member, the insert and the inner member are retained in superimposed positions by the tab means to form a link assembly.

In addition means are provided for connecting a plurality of the link assemblies together in end-to-end relationship to form a bracelet linkage.

In a preferred embodiment the insert comprises spaced flanges extending downwardly from its upper member with their lower ends in engagement with the upper surface of the inner member for holding the upper member of the insert in at least the major portion of the central opening.

In another embodiment the spaced flanges of the insert are positioned adjacent to the inner ends of the slot means.

In a further embodiment each link assembly includes a solid member having opposite walls positioned between the spaced flanges of the insert.

In a still further embodiment the spaced flanges of the insert frictionally engage opposite walls of the solid member for retaining it in position relative to the other elements of the link assembly.

In another embodiment the spaced side members and end members of each outer member include downwardly extending flanges which are in face-to-face relationship with the side flanges and the end members of the inner member in each link assembly.

In a further embodiment each insert comprises side and end flanges extending downwardly from its upper member.

In yet another embodiment the side flanges of the insert are adjacent to the sides of the central opening of the outer member.

In still another embodiment each link assembly includes a solid member positioned between the lower surface of the upper member of the insert and the upper surface of the bottom wall of the inner member.

In another embodiment the insert includes a pair of spaced downwardly extending members which frictionally engage opposite walls of the solid member.

In another preferred embodiment the insert consists of a solid member the upper portion of which is receivable within at least the major portion of the central opening of the outer member and the insert also includes a pair of oppositely positioned outwardly extending members the upper surfaces of which are positioned below the upper portion and which, in the link assembly, face the lower surfaces of the spaced side members of the outer member for limiting the upward movement of the insert relative to the outer member.

In another embodiment the bottom surface of the solid insert is in face-to-face relationship with the upper surface of the bottom wall of the inner member and the upper surfaces of the outwardly extending members of the insert face the lower surfaces of the spaced side members of the outer member.

In still another embodiment the solid insert also includes a pair of spaced side walls which extend downwardly of the outwardly extending members, and in the link assembly, these side walls are in face-to-face relationship with the upwardly extending side flanges of the inner member.

In a further embodiment the solid insert also has a pair of spaced end walls which in the link assembly are located adjacent to the inner ends of the slot means in the bottom wall of the inner member.

In a preferred embodiment the means for connecting a plurality of link assemblies together includes a plurality of connector links each of which extends through the slot means of the ends of adjacent link assemblies and about the ends of the tab means, thereby connectng a plurality of link assemblies together in end-to-end relationship and concealing the tab means.

In yet another embodiment the ends of the connector links are rolled about the tab means during assembly of the linkage and the intervening portion of each connector link is visible from the top in the assembled linkage.

In a further embodiment the outer member includes downwardly extending flanges which substantially conceal the inner member and the insert when the link assembly is viewed from the sides and ends.

BRIEF DESCRIPTION OF THE DRAWINGS

FIG. 11 is an enlarged plan view of one of the inserts of a link assembly embodying the invention;

FIG. 12 is a side view of the insert shown in FIG. 11 partially broken away and shown in section;

FIG. 13 is an end view of the insert shown in FIG. 11 with parts broken away and shown in section;

FIG. 14 is an enlarged plan view of an inner member of a link assembly embodying the invention;

FIG. 15 is a side view of the inner member shown in FIG. 14 with parts broken away and shown in section;

FIG. 16 is an end view of the inner member shown in FIG. 14 with parts broken away and shown in section;

FIG. 17 is an enlarged exploded isometric view showing an outer member, an insert, a solid member and an inner member in positions to be assembled to form a link assembly embodying the invention of the first embodiment;

FIG. 18 is an isometric view of a link assembly;

FIG. 19 is an enlarged exploded isometric view showing an outer member, a solid insert and an inner member in positions to be assembled to form a link assembly of a second embodiment of the invention;

FIG. 20 is a cross section of a link assembly of the second embodiment similar to the section of FIG. 5 of the first embodiment;

FIG. 21 is an enlarged section with parts broken away showing a link assembly of the second embodiment and one end of a connector link for use in connecting link assemblies together to form a bracelet embodying the second embodiment of the invention;

DETAILED DESCRIPTION OF THE FIRST EMBODIMENT OF THE INVENTION

Figure 1:
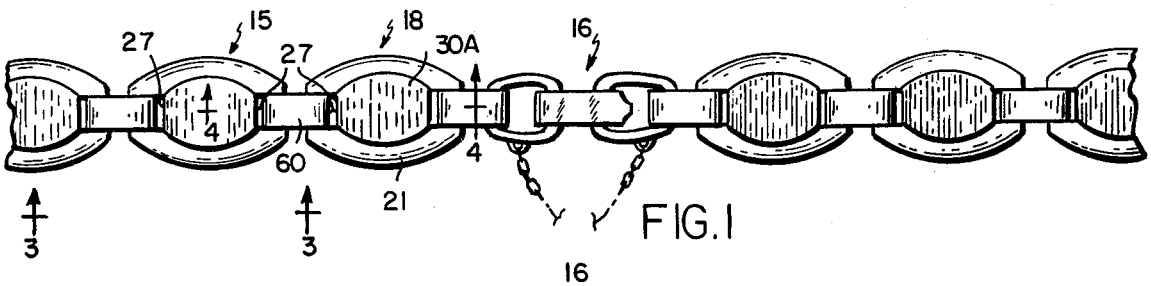
FIG. 1 is a plan view of a first embodiment of a bracelet linkage embodying the invention.
Figure 2:
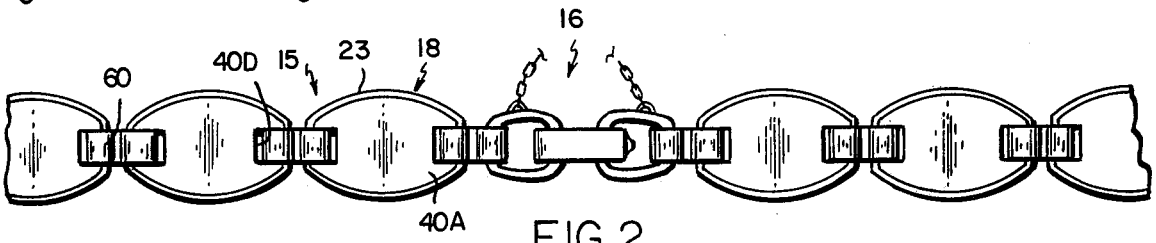
FIG. 2 is a bottom view of the linkage shown in FIG. 1.
Figure 3:
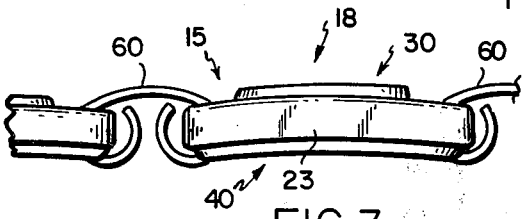
FIG. 3 is an enlarged side elevation of the linkage shown in FIG. 1 looking in the direction of the arrows 3 of FIG. 1.

Referring now to the drawings, a first embodiment of a bracelet linkage embodying the invention is shown in FIGS. 1 through 18 and is generally indicated by the numeral 15. It has general application to wrist watch bracelets, identification bracelets or the like.

In the embodiment shown in said figures of the drawings, two linkages are shown the adjacent ends of which are secured together by a clasp 16 which may be of any well known prior art construction. When used as a wrist watch bracelet the other ends of the bracelet linkages are secured by end connectors (not shown) to the lugs of a wrist watch (not shown). The clasp 16 can be opened to permit a wrist watch and bracelet linkage to be slipped over the hand of the user to encircle his wrist and closed to detachably hold the bracelet and wrist watch about his wrist.

Each link assembly 18 comprises a thin outer member 20 (FIGS. 8, 9, 10 and 17) which may be made of gold-filled, rolled gold plate or stainless steel materials of about 0.010" in thickness. It can be easily embossed with selected designs or textures to provide an ornamental surface for its outer wall 21. The outer member 20 is provided with a central opening 22.

The outer member also comprises a pair of spaced side members 23 and a pair of spaced end members 24 which extend downwardly from the sides of the outer wall 21.

A pair of bendable tab means 25 extend downwardly from the end member 24 of the outer wall.

Each link assembly also includes an insert 30 (FIGS. 11, 12, 13 and 17) which comprises an upper member 30A which is receivable in the central opening 22 of the outer member. This insert also comprises spaced end flanges 30B which extend downwardly from its ends, the functions of which will be explained infra.

Figure 5:
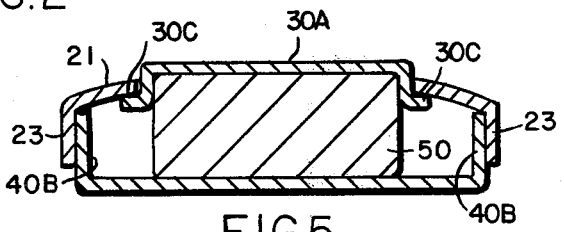
FIG. 5 is a section on the lines 5—5 of FIG. 4.
Figure 4:
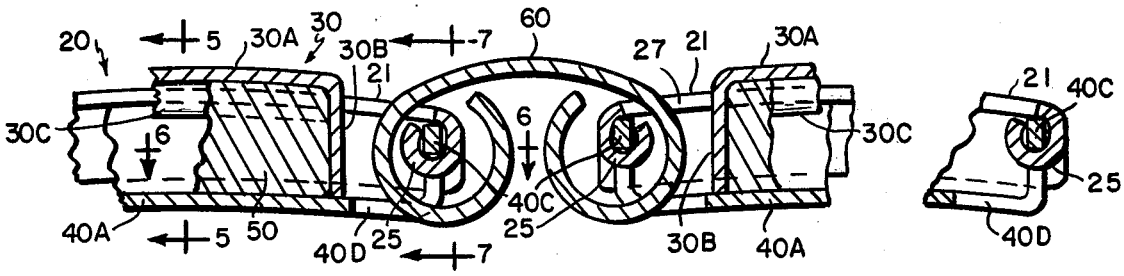
FIG. 4 is an enlarged section on the lines 4—4 of FIG. 1 with parts broken away.

The insert also comprises relatively short side flanges 30C which engage the bottom surface of the outer wall 21 adjacent to the opening 22 of the outer member as shown in FIGS. 4 and 5. This insert may be made of gold-filled, rolled gold plate or stainless steel materials of about 0.010" thickness. The surface of the upper member 30A can be easily embossed with selected designs or textures to provide an ornamental surface which either matches or contrasts with the ornamental surface of the outer wall 21 of the outer member as desired.

Each link assembly also includes an inner member 40 which comprises a bottom wall 40A, side flanges 40B and end flanges 40C as best shown in FIGS. 14, 15, 16 and 17. A pair of slots 40D extend through the lower portions of the end flanges 40C and the adjacent end portions of the bottom wall 40A. This inner member may be made of stainless steel of about 0.010" thickness.

Preferably each link assembly also includes a solid member 50 to provide weight to the bracelet linkage. This member may be made of stainless steel which may be stamped from a strip of about 0.062" in thickness.

To assemble a link assembly 18, the solid member 50 is placed between the flanges 30B of the insert. These flanges are spaced such a distance apart that they frictionally engage the end walls of the solid member to hold it in the desired position relative to the insert and the link assembly. The flanges 30B are also of such a length that their lower ends rest upon the bottom wall 40A of the inner member when the top wall of the insert is positioned in the central opening 22 of the outer member as best shown in FIGS. 4 and 5.

Figure 6:
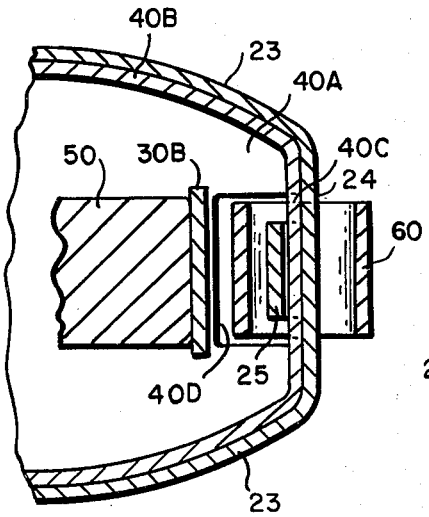
FIG. 6 is a section on the lines 6—6 of FIG. 4.
Figure 7:
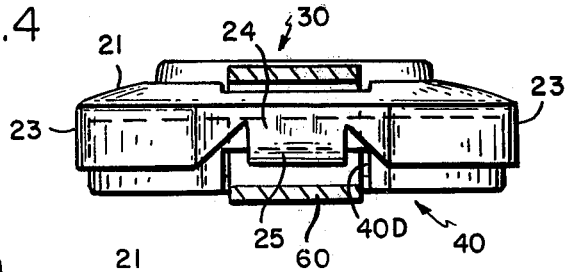
FIG. 7 is a section on the lines 7—7 of FIG. 4.
Figure 8:
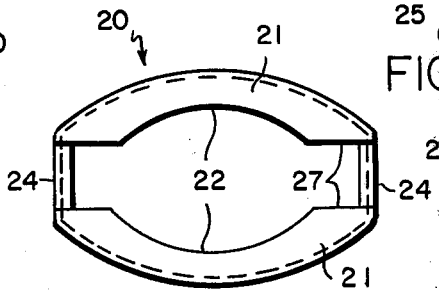
FIG. 8 is an enlarged plan view of one of the outer members of one of the link assemblies.
Figure 10:
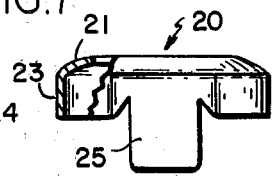
FIG. 10 is an end view of the outer member shown in FIG. 8 with parts broken away and shown in section.
Figure 9:
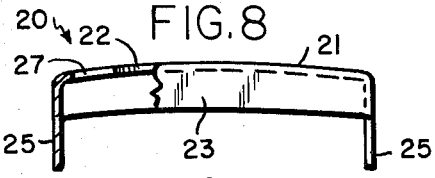
FIG. 9 is a side view of the outer member shown in FIG. 8 with the left-hand portion broken away and shown in section.
Figure 22:
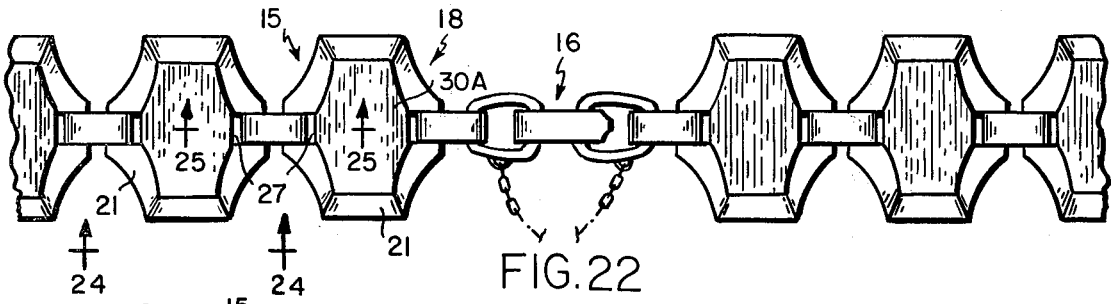
FIG. 22 is a plan view of a third embodiment of a bracelet linkage embodying the invention.
Figure 23:
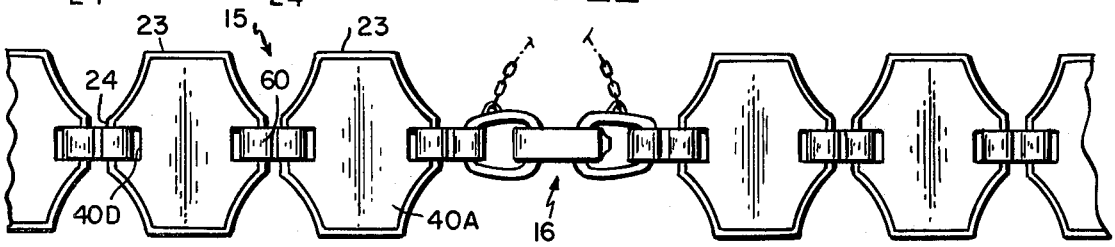
FIG. 23 is a bottom view of the linkage shown in FIG. 22.
Figure 24:
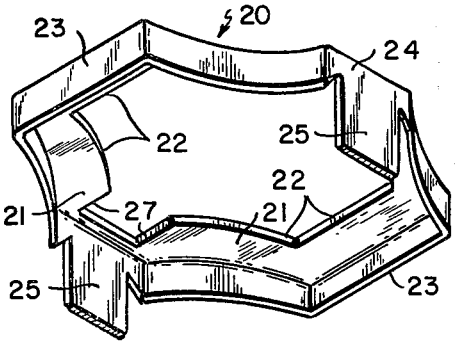
FIG 24 is an enlarged side elevation of the linkage shown in FIG. 22 looking in the direction of the arrwos 24—24 of FIG. 22.
Figure 24:
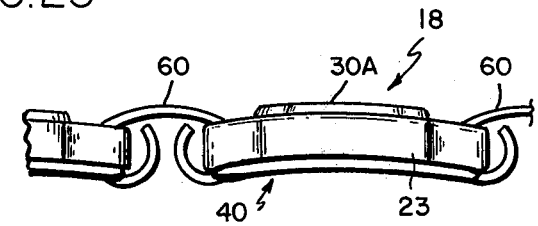
Figure 25:
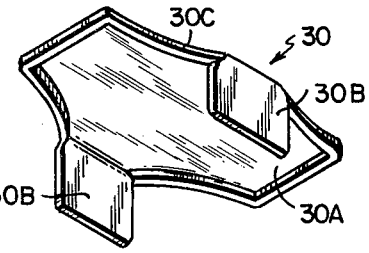
FIG. 25 is an enlarged section on the lines 25—25 of FIG. 22.
Figure 25:
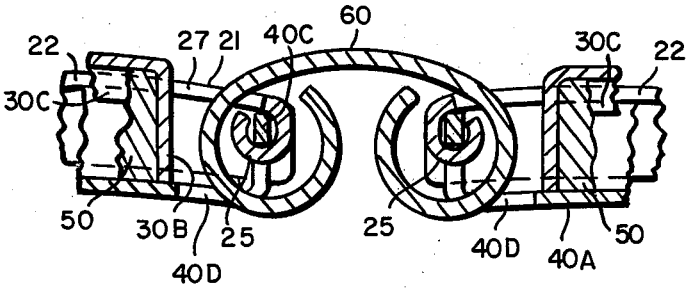
Figure 26:
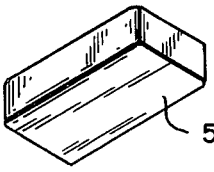
FIG. 26 is an enlarged exploded isometric view showing an outer member, an insert, a solid member and an inner member in positions to be assembled into a link assembly embodying the third embodiment of the invention.
Figure 26:
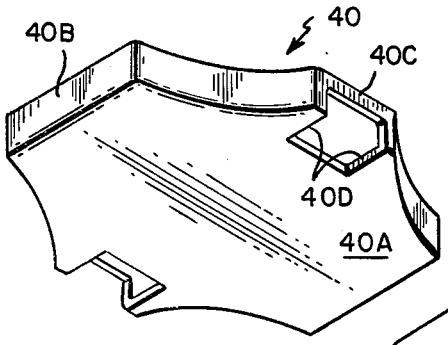
Figure 27:
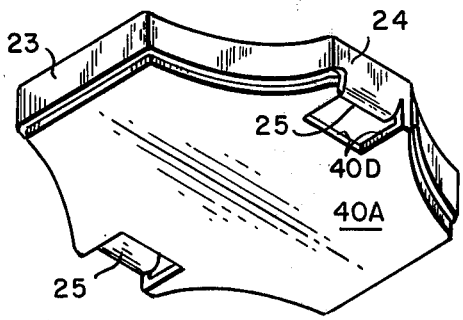
FIG. 27 is an enlarged isometric view of a link assembly of the third embodiment of the invention.

When the outer member, insert, solid member and inner member have been tentatively assembled as above described, the tabs 25 are rolled or otherwise bent about the end members 40C so that their ends extend thru the slots 40D as shown in FIGS. 4, 6 and 7. This retains the parts in superimposed positions to form a link assembly embodying the invention.

The solid member 50 may be omitted without departing from the invention in its broadest aspect.

The link assemblies 18 are connected together in end-to-end relationship to form a linkage for a bracelet by a plurality of connecting links 60. These connecting links are made of gold-filled or rolled gold plate on a pure nickel base or stainless steel materials and are about 0.015" in thickness. As shown in FIGS. 1 through 4, 6 and 7, they extend through the ends 27 of the openings 22 of adjacent outer members, through the slot means 40D of adjacent inner members and about the ends of the tab means 25. Thus they conceal the tab means as best shown in FIGS. 1, 2, 4 and 6.

Bracelet linkages embodying the first embodiment of this invention have satisfied the above described objects and have provided the above described advantages.

DETAILED DESCRIPTION OF THE SECOND EMBODIMENT OF THE INVENTION

A second embodiment of a bracelet linkage embodying the invention is shown in FIGS. 19 thru 21 of the drawings.

Each link assembly comprises an outer member 20 and an inner member 40 which are of the same constructions as the outer and inner members of the first embodiment. The elements of these outer and inner members have been designated by the same numerals as are used for them in FIGS. 1 thru 18.

The insert 55 of the second embodiment is solid. It may be made of molded plastic materials and plastic materials of various colors may be used if desired. Its upper surface may be textured, modulated or otherwise provided with suitable designs. The insert can also be made of metal which may be cast, forged or machined to provide the desired shape and also to provide desired designs for its upper surface.

The insert 55 comprises an upper member 55A which is receivable within at least the major portion of the central opening 22 of the outer member 20.

It also comprises a pair of oppositely positioned outwardly extending members 55B the upper surfaces of which are positioned below the upper portion 55A and face the lower surfaces of the spaced side members of the outer wall 21 of the outer member 20 for limiting the upward movement of the insert relative to the outer member as shown in FIG. 20.

The bottom surface 55C of the insert is in face-to-face relationship with the upper surface of the bottom wall 40A of the inner member and the upper surfaces of the outwardly extending members 55B face the lower surfaces of the side members 21 of the outer member in the link assembly as shown in FIGS. 20 and 21.

The outwardly extending members 55B comprise a pair of spaced side walls 55D which are in face-to-face relationship with the upwardly extending flanges 40B of the inner member in the link assembly as shown in FIG. 20.

The solid insert also comprises a pair of spaced end members 55E which are located adjacent to the inner ends of the slots 40D in the bottom wall of the inner member in the link assembly.

The outer member 20, solid insert 55A and inner member 40 are assembled by inserting the tabs 25 through the slots 40D and bending their ends about the end flanges 40C as shown in FIG. 21. Then the connector links are are rolled about the ends of the tabs 25 to connect a plurality of link assemblies together in end-to-end relationship to form a bracelet embodying the invention.

Bracelet linkages embodying the second embodiment of this invention have satisfied the above described objects and have provided the above described advantages.

DETAILED DESCRIPTION OF THE THIRD EMBODIMENT OF THE INVENTION

A third embodiment of a bracelet linkage embodying the invention is shown in FIGS. 22 through 27 of the drawings. The elements are the same as the elements of the first embodiment except that the outer members, the inserts and inner members are provided with different outlines as shown by comparing FIGS. 22 thru 27 with FIGS. 1 thru 18 which show the first embodiment.

Consequently we have applied the same numerals to the elements shown in FIGS. 22 thru 27 as are applied to the elements of FIGS. 1 thru 18 of the drawings.

The methods of assembly of each link assembly and of the linkage of this third embodiment are the same as in the first embodiment.

Bracelet linkages embodying the third embodiment of this invention have satisfied the above described objects and have provided the above described advantages.

DETAILED DESCRIPTION OF THE FOURTH EMBODIMENT OF THE INVENTION

Figure 28:
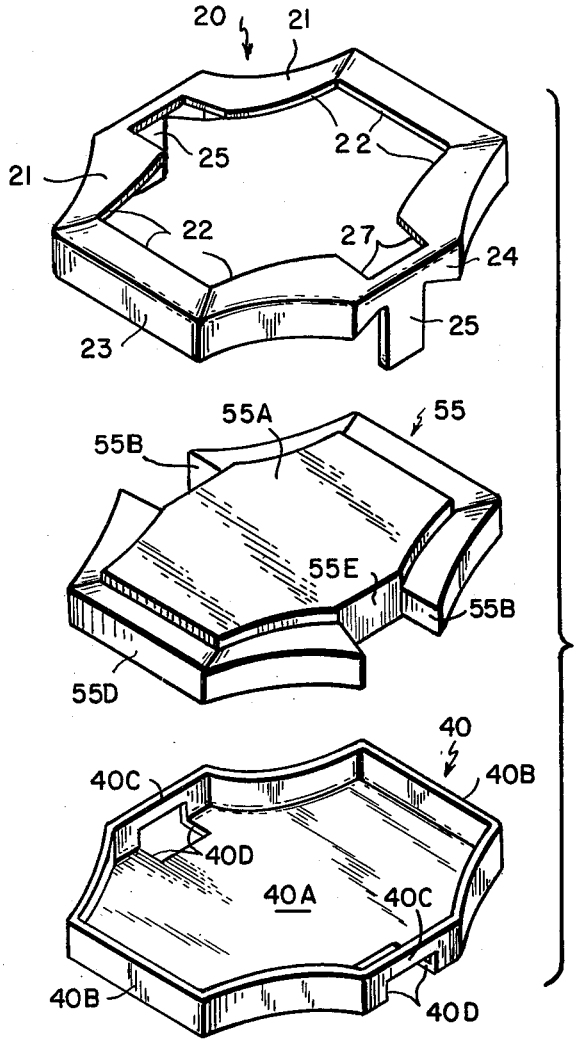
FIG. 28 is an enlarged exploded isometric view showing an outer member, a solid insert and an inner member in positions to be assembled to form a link assembly of a fourth embodiment of the invention.
Figure 29:
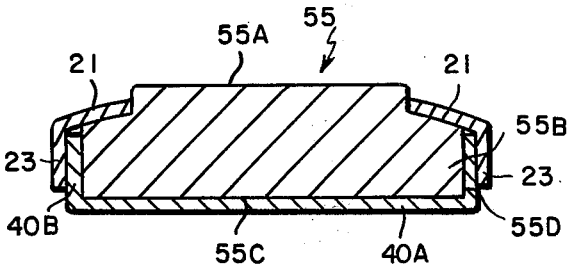
FIG. 29 is a cross section of a link assembly of the fourth embodiment similar to the section of FIG. 5 of the first embodiment.
Figure 30:
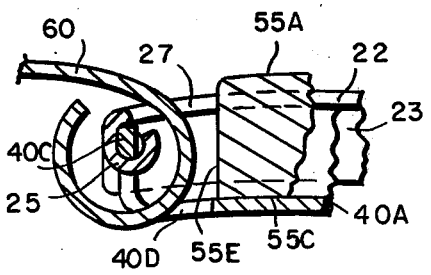
FIG. 30 is an enlarged section with parts broken away showing a link assembly of the fourth embodiment and one end of a connector link for use in connecting link assemblies together in end-to-end relationship to form a bracelet embodying the fourth embodiment of the invention.

A fourth embodiment of a bracelet linkage comprising the invention is shown in FIGS. 28, 29 and 30 of the drawings. The elements are the same as the elements of the second embodiment except that the outer members, the solid inserts and inner members are provided with different outlines as shown by comparing FIGS. 28, 29 and 30 with FIGS. 19, 20 and 21 respectively of the second embodiment.

Consequently we have applied the same numerals to the elements shown in FIGS. 28, 29 and 30 as are applied to the elements of FIGS. 19, 20 and 21 of the drawings.

The methods of assembly of each link assembly and of the linkage of this fourth embodiment are the same as in the second embodiment.

Bracelet linkages embodying the fourth embodiment of this invention have satisfied the above described objects and have provided the above described advantages.

While four embodiments of bracelet linkages embodying the invention have been shown in the drawings and described in the specification, it is to be understood that this disclosure is for the purpose of illustration only and that various changes in shape, proportion and arrangement of parts as well as the substitution of equivalent elements for those shown and described herein may be made without departing from the spirit and scope of the invention as set forth in the appended claims.

We claim:

1. A bracelet linkage comprising, a plurality of link assemblies each of which comprises, an outer member comprising a pair of spaced side members, a pair of spaced end members extending between the side members to define a frame having a central opening, and a pair of bendable tab means, one extending downwardly from each of said end members, an insert receivable within said outer member, said insert having an upper member exposed by said opening an inner member comprising a bottom wall, side flanges extending upwardly from said bottom wall, a pair of end members extending between said side flanges and a pair of slot means at the junction of lower portions of said end members and the adjacent end portions of said bottom wall, said bendable tab means being bent about said end members of the inner member with their ends extending through said slot means, whereby the outer member, the insert and the inner member are retained in superimposed positions by said tab means to form a link assembly, and means for connecting a plurality of said link assemblies together in end-to-end relationship to form a bracelet.

2. A linkage according to claim 1 wherein the spaced side members and end members of each outer member comprise downwardly extending flanges which are in face-to-face relationship with the side flanges and the end members of the inner member in each link assembly.

3. A linkage according to claim 1 wherein said insert comprises spaced flanges extending downwardly from said upper member with their lower ends in engagement with the bottom wall of said inner member for holding the upper member of the insert in at least the major portion of said central opening.

4. A linkage according to claim 3 wherein said spaced flanges of the insert are positioned adjacent to the inner ends of said slot means.

5. A linkage according to claim 3 which also comprises a solid member having opposite walls positioned between said spaced flanges of the insert.

6. A linkage according to claim 5 wherein said spaced flanges frictionally engage opposite walls of the solid member for retaining it in position relative to the other elements of the link assembly.

7. A linkage according to claim 1 wherein each insert comprises side and end flanges extending downwardly from its upper member.

8. A linkage according to claim 7 wherein said side flanges of the insert are adjacent to the sides of the central opening of the outer member.

9. A linkage according to claim 1 which also comprises a solid member positioned between the lower surface of the upper member of the insert and the upper surface of the bottom wall of the inner member.

10. A linkage according to claim 9 wherein the insert comprises a pair of spaced downwardly extending members which frictionally engage opposite walls of said solid member.

11. A linkage according to claim 1 wherein said insert consists of a solid member the upper portion of which is receivable within at least the major portion of the central opening of the outer member, said insert also comprising a pair of oppositely positioned outwardly extending members the upper surfaces of which are positioned below said upper portion and which in the link assembly face the lower surfaces of the spaced side members of the outer member for limiting the upward movement of the insert relative to the outer member.

12. A linkage according to claim 11 wherein in the link assembly the bottom surface of the solid insert is in face-to-face relationship with the upper surface of the bottom wall of the inner member.

13. A linkage according to claim 11 wherein the said outwardly extending members of the solid insert comprise a pair of spaced side walls and in the link assembly, said side walls are in face-to-face relationship with the upwardly extending side flanges of the inner member.

14. A linkage according to claim 11 wherein the solid insert also comprises a pair of spaced end walls which are located adjacent to the inner ends of the slot means in the bottom wall of the inner member in the link assembly.

15. A linkage according to claim 1 wherein said means for connecting a plurality of link assemblies together comprises a plurality of connector links each of which extends through said slot means of the ends of adjacent link assemblies and about the ends of said tab means, thereby connecting a plurality of said link assemblies together in end-to-end relationship and concealing said tab means.

16. A linkage according to claim 15 wherein the ends of said connector links are rolled about said tab means during assembly of the linkage and the intervening portion of each connector link is visible from the top in the assembled linkage.

17. A linkage according to claim 1 wherein the outer member comprises downwardly extending flanges which substantially conceal the inner member and the insert when the link assembly is viewed from the sides and ends.

* * * * *